US006990306B2

(12) United States Patent
Mochizuki

(10) Patent No.: US 6,990,306 B2
(45) Date of Patent: Jan. 24, 2006

(54) DEVELOPING AGENT AND IMAGE FORMING APPARATUS

(75) Inventor: Takahiro Mochizuki, Komae (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/459,511

(22) Filed: Jun. 12, 2003

(65) Prior Publication Data

US 2003/0203303 A1 Oct. 30, 2003

Related U.S. Application Data

(63) Continuation of application No. 09/667,520, filed on Sep. 22, 2000, now abandoned.

(51) Int. Cl.
*G03G 15/08* (2006.01)
*G03G 9/08* (2006.01)

(52) U.S. Cl. ..... 399/252; 399/159; 430/108.3; 430/108.7; 430/56; 430/124

(58) Field of Classification Search ..... 430/108.3, 430/56, 108.7, 124, 120; 399/159, 252, 338
See application file for complete search history.

(56) References Cited

U.S. PATENT DOCUMENTS

| | | | | |
|---|---|---|---|---|
| 4,985,328 | A * | 1/1991 | Kumagai et al. | 430/108.23 |
| 5,114,814 | A * | 5/1992 | Sakoh et al. | 430/46 |
| 5,567,563 | A * | 10/1996 | Minami | 430/108.4 |
| 5,747,213 | A * | 5/1998 | Okado et al. | 430/124 |
| 6,040,101 | A | 3/2000 | Naka et al. | |
| 6,214,507 | B1 | 4/2001 | Sokol et al. | |

FOREIGN PATENT DOCUMENTS

| | | | |
|---|---|---|---|
| JP | 63-096664 | A | 4/1988 |
| JP | 1-136165 | A | 5/1989 |
| JP | 2-037363 | A | 2/1990 |
| JP | 6-118721 | A | 4/1994 |
| JP | 7-319274 | A | 12/1995 |
| JP | 8-152735 | A | 6/1996 |
| JP | 8-202073 | A | 8/1996 |
| JP | 8-262756 | A | 10/1996 |
| JP | 8-272132 | A | 10/1996 |
| JP | 8-334926 | A | 12/1996 |
| JP | 9-190125 | A | 7/1997 |
| JP | 11-265086 | A | 9/1999 |

OTHER PUBLICATIONS

US. Patent & Trademark Office English-Language Translation of JP 63-096664 (publ. Apr. 1988).*
AS, Diamond et al., *Handbook of Imaging Materials*, Marcel Dekker, Inc., NY (1991), p. 169, paragraph 4.2.4.*
U.S. Patent & Trademark Office English-Language Translation of JP 63-096664 (publ. Apr. 1988).
Derwent Abstract Acc. No. 1988-157390 describing JP 63-096664, Mar. 1996.
Caplus Abstract Acc. No. 1988:539144 describing JP 63-096664, Apr. 27, 1988.
Calplus Abstract Acc. No. 1987:555534, GB 2,182,341, May 13, 1987.
A. S. Diamond et al., "Handbook of Imaging Materials", Marcel Dekker, Inc., NY (1991), p. 169, paragraph 4.2.4 (1991).

* cited by examiner

*Primary Examiner*—Janis L. Dote
(74) *Attorney, Agent, or Firm*—Foley & Lardner LLP

(57) ABSTRACT

An image is formed by using in combination a photoreceptor having a surface roughness Rz not larger than 1.0 and a developing agent comprising a toner containing toner particles containing a binder resin and a coloring agent, silica particles, and a metal soap, the weight ratio of the silica particles to the metal soap falling within a range of between 10 and 60.

4 Claims, 1 Drawing Sheet

DEVELOPING AGENT AND IMAGE FORMING APPARATUS

The present application is a Continuation of U.S. application Ser. No. 09/667,520, filed Sep. 22, 2000, now abandoned, the entire contents of which are incorporated herein by reference.

BACKGROUND OF THE INVENTION

The present invention relates to an image forming apparatus of an electrostatic recording system, an electrophotographic system, etc., and a developing agent used in such an image forming apparatus.

In recent years, the wax content of the toner is increased in order to cope with the high speed operation of a copying machine and a printer and with the oil-free system of a fixing device. If the wax content is increased, the free wax is increased within the developing agent so as to impair the frictional charging between the toner and the carrier. As a result, the charging is shifted toward the zero charging so as to cause the carrier to be attached to the photoreceptor. Also, if the developing agent is stored over a long period of time, the coating agent of the carrier is peeled off, and the wax is attached to the peeled portion so as to impair the charging properties. As a result, the carrier is deteriorated so as to deteriorate the image quality. As a measure for overcoming these problems, it was customary in the past to mix an inorganic oxide with the toner particles so as to allow the inorganic oxide to be attached to the surface of the toner particle. As such an inorganic oxide, it was customary to use, for example, silica particles because silica particles permit the developing agent to be excellent in the charging properties and in the stability during storage of the developing agent over a long period of time. In addition, silica particles are low in the manufacturing cost.

Where silica particles alone are mixed, it is certainly possible to improve the charging properties and the toner fluidity. However, where the addition amount of the silica particles is large and where the adhesion strength of the silica particles to the toner particles is low, the toner attached to the photoreceptor is interlocked, and the interlocked toner causes a black dot to appear on the reproduced image. The surface roughness Rz of the photoreceptor is a large factor for bringing about the particular phenomenon. In other words, the occurrence of the black dot can be markedly suppressed when it comes to a photoreceptor having a small surface roughness Rz.

Also, in order to lower the frictional resistance on the surface of the photoreceptor, it is highly effective to add a metal soap. The addition of the metal soap also permits lowering the frictional resistance with a cleaning blade and, thus, is effective for prolonging the life of the photoreceptor. However, the addition of the metal soap causes contamination of the carrier, making it necessary to decrease the addition amount of the metal soap as much as possible.

BRIEF SUMMARY OF THE INVENTION

A first object of the present invention, which has been achieved in view of the situation described above, is to provide a developing agent satisfactory in charging properties and storage properties and capable of forming an image excellent in fixing properties and reproducibility without bringing about the carrier attachment, the contamination within the image forming apparatus, and black dot generation on the image in the image forming step.

A second object of the present invention is to provide an image forming apparatus capable of forming an image excellent in fixing properties and reproducibility without bringing about the carrier attachment, the contamination within the image forming apparatus, and black dot generation on the image.

According to a first aspect of the present invention, there is provided a developing agent applied to an image carrier having a surface roughness Rz not larger than 1.0, comprising toner containing toner particles containing a binder resin and a coloring agent, silica particles, and a metal soap, the weight ratio of the silica particles to the metal soap falling within a range of between 10 and 60.

According to a second aspect of the present invention, there is provided an image forming apparatus, comprising:

an image carrier having a surface roughness Rz not larger than 1.0;

a developing device arranged to face the image carrier, housing a developing agent comprising toner containing toner particles containing a binder resin and a coloring agent, silica particles, and a metal soap, the weight ratio of the silica particles to the metal soap falling within a range of between 10 and 60, and serving to develop an electrostatic latent image formed on the image carrier so as to form a developing agent image;

a transfer device for transferring the developing agent image onto a transfer material; and a fixing device having a heating member and serving to fix the developing agent image transferred onto the transfer material.

The developing agent of the present invention is satisfactory in the fixing performance, the charging characteristics and the storage characteristics, and permits the image forming apparatus not to be contaminated. Also, a black dot is not generated and the life of the photoreceptor is prolonged, making it possible to form a satisfactory image even under a high humidity and near the end of the life of the developing agent.

According to another aspect of the present invention, there has been provided an image forming apparatus wherein the fixing device is of an oil free type in which a releasing agent is not supplied to the heating member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention is directed to a developing agent applied to an image carrier having a surface roughness Rz not larger than 1.0 and comprising toner containing toner particles containing a binder resin and a coloring agent, silica particles, and a metal soap, the weight ratio of said silica particles to said metal soap falling within a range of between 10 and 60.

The present invention also provides an image forming apparatus using the developing agent defined above, comprising:

an image carrier having a surface roughness Rz not larger than 1.0;

a developing device arranged to face said image carrier, housing a developing agent comprising toner containing toner particles containing a binder resin and a coloring agent, silica particles, and a metal soap, the weight ratio of said silica particles to said metal soap falling within a range of between 10 and 60, and serving to develop an electrostatic latent image formed on said image carrier so as to form a developing agent image;

a transfer device for transferring said developing agent image onto a transfer material; and a fixing device having a heating member and serving to fix the developing agent image transferred onto said transfer material.

According to the present invention, thus silica particles and a metal soap used as additives are added to the developing agent applied to an image carrier having a surface roughness Rz not larger than 1.0 in a weight ratio meeting the formula:

$$10 \leqq \text{silica particles/metal soap} \leqq 60$$

As a result, it is possible to improve the charging properties and the toner fluidity while avoiding the contamination of the carrier and the generation of the black point caused by the interlocking of the toner to the photoreceptor, with the result that it is possible to form an excellent image.

As described above, silica is effective for preventing the carrier attachment, for improving the charging properties and for ensuring the storage properties, though a black point on an image carrier is caused by silica. In the present invention, silica having the particular properties is effectively used in combination with a metal soap effective for preventing the black point.

The surface roughness Rz used in the present specification represents a ten point average roughness, which is measured as follows.

Figure 1:
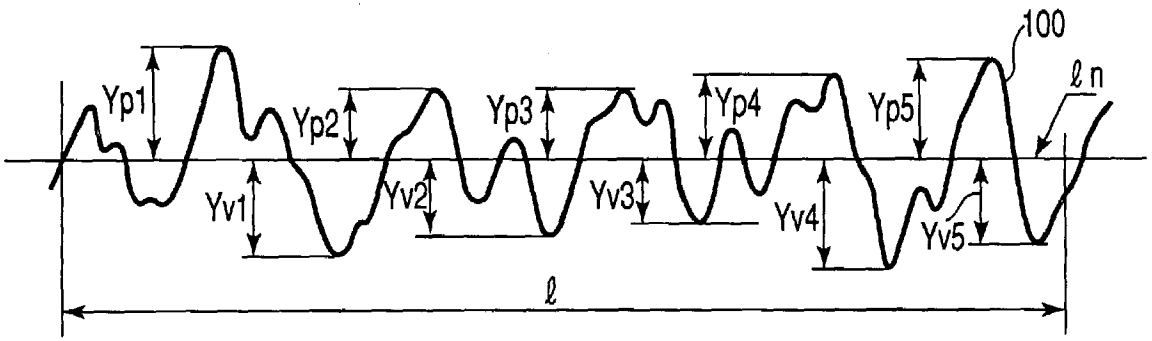
FIG. 1 shows the measuring method of the surface roughness Rz.

Specifically, FIG. 1 shows how to measure the surface roughness Rz. As shown in the drawing, a roughness curve 100 is taken from a roughness curve measured by a contact type surface roughness meter in which the surface roughness is measured by bringing, for example, a needle or a sensor into direct contact with a target object to be measured or measured by a non-contact type surface roughness meter in which the surface roughness is measured by irradiating a target object with a non-visible light. The roughness curve measured by the surface roughness meter is taken in a standard length l in the direction of an average line ln for preparing the roughness curve 100. The surface roughness Rz ($\mu$m) represents the sum of the average value of the height Yp1, Yp2, Yp3, Yp4 and Yp5 of the first to fifth highest peaks and the average value of the depth Yv1, Yv2, Yv3, Yv4 and Yv5 of the first to fifth deepest valleys in the taken-up portion of the roughness curve 100.

A black point is generated, if the surface roughness Rz exceeds 1.

Where silica particles are not contained in the developing agent, the fluidity and the charging properties of the toner are rendered extremely poor, giving rise to the contamination within the image forming apparatus, a lowered image quality and a carrier attachment. On the other hand, where a metal soap is not contained in the developing agent, the toner is likely to be attached to the photoreceptor regardless of the surface roughness Rz of the photoreceptor, giving rise to a black point generation.

It is desirable for the metal soap to be contained in the toner in an amount of 0.008 to 0.01% by weight. If the metal soap content exceeds 0.01% by weight, the charging properties of the toner are rendered poor, giving rise to various difficulties that the image concentration tends to be lowered, that the image quality tends to be deteriorated, and that the inner region of the image forming apparatus tends to be contaminated. On the other hand, if the metal soap content is lower than 0.008% by weight, a black point tends to be generated.

It is desirable for the silica particles to be contained in the toner in an amount of 0.08 to 0.6% by weight. If the silica particle content exceeds 0.6% by weight, the charging amount of the toner is increased, with the result that the image concentration tends to be lowered under a low temperature and a low humidity. On the other hand, if the silica particle content is lower than 0.08% by weight, difficulties tend to be brought about in respect of contamination in the inner region of the image forming apparatus, a low image quality, and a carrier attachment.

It is possible for the toner particles to contain preferably not higher than 7% by weight, more preferably 5 to 7% by weight, of wax. If was is added, the fixing performance of the toner can be improved.

It is possible for the developing agent of the present invention to further contain a carrier. It is desirable to use a silicone-coated carrier in the present invention. In the case of using a silicone-coated carrier, friction between the carrier and the toner takes place within the developing device, with the result that the carrier itself is caused to be attached to the photoreceptor by the triboelectrification. It follows that it is possible to obtain a charging amount sufficient for developing an electrostatic latent image with the toner without doing damage to the surface of the photoreceptor.

Figure 2:
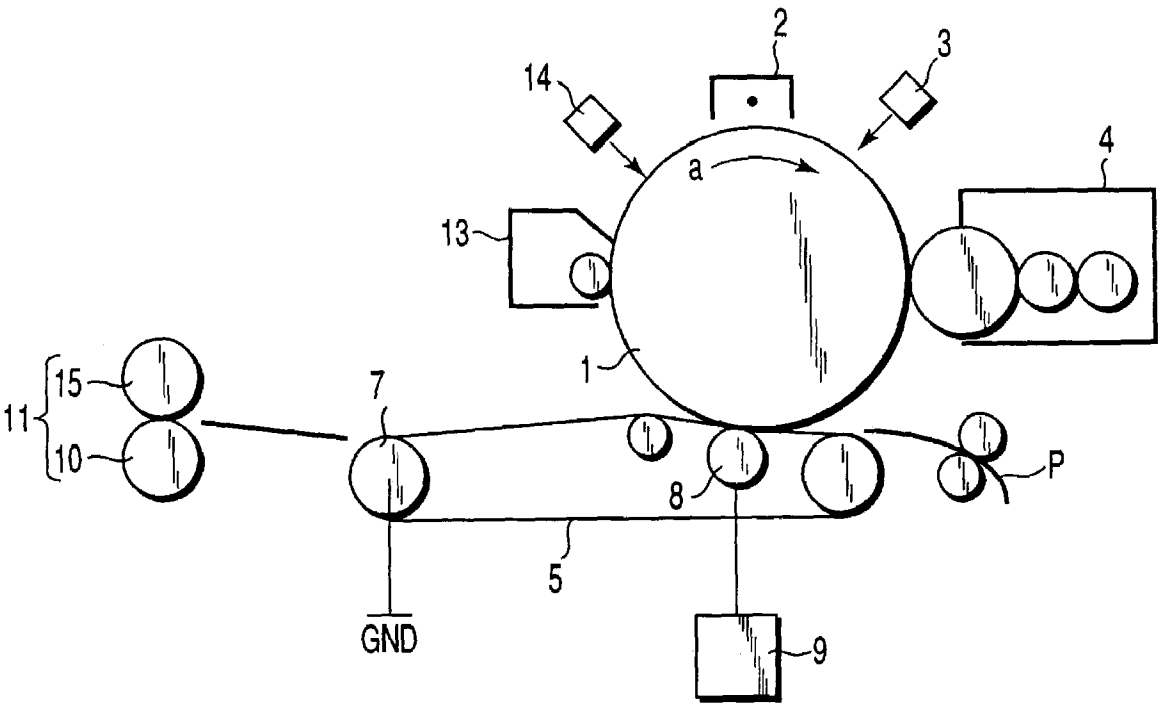
FIG. 2 schematically shows the construction of an image forming apparatus according to one embodiment of the present invention.

FIG. 2 schematically shows the construction of an image forming apparatus according to one embodiment of the present invention. As shown in the drawing, a surface potential of −500 to 800V is uniformly imparted by a charging device 2 to a photoreceptor 1 rotatable in a direction denoted by an arrow "a". An electrostatic latent image is formed on the photoreceptor 1 by a light exposure apparatus 3. The electrostatic latent image is made visible, i.e., developed, by the toner charged negative in a developing device 4. The developing agent used in this developing step comprises a toner containing a coloring agent, toner particles containing a binder resin, silica particles and a metal soap, the weight ratio of the silica particles to the metal soap falling within a range of between 10 and 60. A belt 5 is pressed against the photoreceptor 1 downstream of the developing device 4 in the rotating direction of the photoreceptor 1. As shown in the drawing, a transfer material of a paper sheet P is held between the belt 5 and the photoreceptor 1, and the toner image formed on the photoreceptor 1 is transferred onto the paper sheet P by a bias voltage of, for example, +300 V to 5 kV applied from a high voltage power source 9 to the belt 5. The belt 5 is formed of an elastic belt having a volume resistivity of, for example, $10^8$ Ω·cm to $10^2$ Ω·cm and is supported by a plurality of rollers. The belt 5 is driven by a roller 7 included in the rollers supporting the belt 5. As a result, the belt 5 is rotated at an area moving rate substantially equal to that of the photoreceptor 1. A conductive elastic roller 8 having a volume resistivity of $10^{12}$ Ω·cm to $10^8$ Ω·cm is used as a power supply member, and the power is supplied to the back surface of that region of the belt 5 which is in contact with the photoreceptor 1. In the general printing operation, the belt 5 and the photoreceptor 1 are driven independently with the belt 5 and the photoreceptor 1 held apart from each other, and the belt 5 is brought into contact with the photoreceptor 1 when the belt 5 and the photoreceptor 1 are made substantially equal to each other in the area moving rate. The transfer material of the paper sheet P is transferred simultaneously with application of a transfer bias to the power supply roller 8 so as to reach a transfer nipping region. The paper sheet P passing through the transfer nipping portion between the photoreceptor 1 and the power supply roller 8 is electrostatically sucked by the belt 5. However, since the driving roller 7 of the belt 5 has a small radius of curvature, the tip of the paper sheet P is released from the belt 5 in the most downstream side of the belt unit so as to be transferred to a fixing device 11 through a guide member.

The excess toner attached to the surface of the photoreceptor 1 is removed by a cleaning device 13 arranged to face the photoreceptor 1 downstream of the transfer nipping portion between the power supply roller 8 and the photoreceptor 1, followed by destaticizing the photoreceptor 1 by a destaticizing device 14.

The fixing device 11 comprises a heat roller 15 and a pressurizing roller 10, and the toner image transferred onto the paper sheet is fixed to the paper sheet in the fixing device 11 at a fixing temperature of 160 to 190° C. The fixing device 11 used in this embodiment is not equipped with an oil supply mechanism and, thus, is of an oil-free type.

The present invention will now be described more in detail with reference to some Examples of the present invention.

EXAMPLE 1

Prepared were toner particle materials of the composition given below:

| | |
|---|---|
| Styrene/acrylic resin (CPR-600B ™ manufactured by Mitsui Kagaku K.K.) | 89 parts by weight |
| Carbon black (MA-100 ™ manufactured by Mitsubishi Kagaku K.K.) | 5 parts by weight |
| Charge controlling agent (TRH ™ manufactured by Hodogaya Kagaku K.K.) | 1 part by weight |
| Polypropylene wax (BISCOL 550P ™ manufactured by Sanyo Kasei Kogyo K.K.) | 5 parts by weight |

The toner particle materials given above were uniformly mixed preliminarily, followed by kneading under a molten state the resultant mixture by using a pressurizing kneader. The kneaded material thus obtained was roughly pulverized in a hammer mill. Further, the roughly pulverized material was finely pulverized by a jet pulverizing machine, followed by classifying the finely pulverized material by an air stream classifying machine so as to obtain black toner particles having an average particle diameter of 10 μm.

Further, 0.4 part by weight of a silica fine powder ("R972" manufactured by Japan Aerosil K.K.) and 0.01 part by weight of a metal soap (zinc stearate) were added to 100 parts by weight of the black toner particles, and mixed in a HENSCHEL mixer so as to obtain a black toner. The mixing ratio of the metal soap to the silica fine powder was 40.

Six parts by weight of the toner thus prepared was mixed with 94 parts by weight of a carrier coated with a silicone resin so as to obtain a developing agent. The developing agent thus obtained was housed in a developing device of "Premarju 251" (trade name of a digital copying machine manufactured by Toshiba Corporation) having a construction equal to that shown in FIG. 2 so as to form images. The surface roughness Rz of the photoreceptor included in the copying machine was 0.7 μm.

The developing agent, the developing apparatus, and the formed images thus obtained were tested and evaluated as follows.

Fixing Performance:

An image was formed on a chart for evaluating the fixation manufactured by Toshiba Corporation. After the image formation, a patch in a half tone portion was rubbed with a fastness tester. The fixation remaining rate was calculated from the difference in concentration between the state before the rubbing and the state after the rubbing as follows:

$$R=A/B\times 100(\%)$$

where, R represents the fixation remaining rate, A represents the concentration after the rubbing, and B represents the concentration before the rubbing.

The result is shown in Table 1 as follows:

O: The fixation remaining rate is not lower than 75%;

Δ: The fixation remaining rate is not lower than 70% and lower than 75%;

X: The fixation remaining rate is lower than 70%.

Contamination Within Image Forming Apparatus:

The developing unit was taken out of the copying machine "Premarju 251" referred to previously, and the degree of stains within the copying machine caused by the dropping of the toner, etc. was visually observed.

Table 1 shows the result. The contamination was evaluated as follows:

O: good;

Δ: somewhat poor;

X: poor.

Image Quality Under High Humidity:

An image was formed on a chart for evaluating the image quality manufactured by Toshiba Corporation, and the patch for reproducing fine lines in the central portion of the image was observed with a magnifier.

Table 1 shows the result. The contamination was evaluated as follows:

O: The fine line reproducibility was good;

Δ: The fine line reproducibility was somewhat poor;

X: The fine line reproducibility was poor.

Storage Properties:

Twenty grams of the obtained toner was put in a plastic container and left to stand at 50° C. for 8 hours. Then, the toner was sieved for 10 seconds through 42 meshes by using a powder tester manufactured by Hosokawa Micron K.K. so as to measure the remaining amount of the toner on the mesh.

Table 1 shows the result. The storage properties were evaluated as follows:

O: The remaining amount of the toner was not larger than 1 g;

Δ: The remaining amount of the toner was larger than 1 g and not larger than 5 g;

X: The remaining amount of the toner was larger than 5 g.

Carrier Attachment:

A black solid image was formed by the copying machine "Premarju 251" referred to previously, and the number of carriers attached to the black solid image was visually counted. The portion around the carrier attached point is rendered somewhat whitish, making it possible to count visually the number of carriers attached to the black solid image.

points even under a high temperature and a high humidity, and free from a carrier attachment. Also, a satisfactory image was obtained even after the image forming test on 100,000 paper sheets. Further, the inner region of the copying machine was scarcely contaminated.

Examples 2 to 7 and Comparative Examples 1 to 3

A developing agent was prepared as in Example 1, except that the wax amount, the silica amount, the silica/metal soap weight ratio, and the surface roughness Rz of the photoreceptor were changed as shown in Table 1. Various tests and the evaluations were performed as in Example 1 by using the resultant developing agent. Table 1 also shows the results.

TABLE 1

| | wax amount | silica amount | silica/metal soap ratio | surface roughness Rz of photoreceptor | fixing performance | contamination within copying machine | image quality under high humidity | storage properties | carrier attachment | black point | image quality at life end |
|---|---|---|---|---|---|---|---|---|---|---|---|
| Example 1 | 5 | 0.4 | 40 | 0.7 | ○ | ○ | ○ | ○ | ○ | ○ | ○ |
| Example 2 | 6 | 0.4 | 40 | 0.7 | ○ | ○ | ○ | ○ | ○ | ○ | ○ |
| Example 3 | 7 | 0.4 | 40 | 0.7 | ○ | ○ | ○ | ○ | ○ | ○ | ○ |
| Example 4 | 4 | 0.4 | 40 | 0.7 | Δ | ○ | ○ | ○ | ○ | ○ | ○ |
| Example 5 | 8 | 0.4 | 40 | 0.7 | ○ | Δ | ○ | ○ | Δ | Δ | ○ |
| Comparative Example 1 | 6 | 0.4 | 8 | 0.7 | ○ | X | ○ | Δ | X | ○ | Δ |
| Comparative Example 2 | 6 | 0.4 | 65 | 0.7 | ○ | ○ | ○ | ○ | ○ | X | Δ |
| Example 6 | 6 | 0.08 | 40 | 0.7 | ○ | Δ | ○ | Δ | Δ | ○ | ○ |
| Example 7 | 6 | 0.65 | 40 | 0.7 | ○ | ○ | Δ | ○ | ○ | ○ | ○ |
| Comparative Example 3 | 6 | 0.4 | 40 | 1.1 | ○ | ○ | ○ | ○ | ○ | X | ○ |

Table 1 shows the result. The carrier attachment was evaluated as follows:

O: A carrier was not attached at all;

Δ: 1 to 5 carriers were attached;

X: 6 or more carriers were attached.

Black Point:

An image was formed on a white paper sheet by using the copying machine "Premarju" referred to previously, and the number of black points on the white paper sheet and the number of black points on the drum were visually counted.

Table 1 shows the result. The black point was evaluated as follows:

O: A black point was not formed on any of the drum and the image formed on the white paper sheet;

Δ: 1 to 9 black points were formed;

X: 10 or more black points were formed.

Image Quality at Life End:

A life test was performed by using the copying machine "Premarju" referred to previously, and an image was formed on a chart for evaluating the image manufactured by Toshiba Corporation after the life end (after image formation on 150,000 paper sheets). Then, a patch for reproducing the fine line in a central portion of the image was observed with a magnifier.

Table 1 shows the result. The image quality was evaluated as follows:

O: The fine line reproducibility was good;

Δ: The fine line reproducibility was somewhat poor;

X: The fine line reproducibility was poor.

As apparent from Table 1, obtained were satisfactory images excellent in the fixing performance, free from black In each of Examples 2 to 5, the mixed wax amount was changed. In Example 4 in which the wax amount was small, the fixing performance was somewhat poor. On the other hand, black points were somewhat generated in Example 5 in which the wax amount was large. However, satisfactory results were obtained in respect of any of the fixing performance, the black point generation, the carrier attachment, the storage properties, the contamination within the copying machine, and the image quality under a high humidity and at the life end of the developing agent in any of Examples 1 to 3.

The weight ratio of silica/metal soap was changed in each of Comparative Examples 1 and 2. In Comparative Example 1 in which the silica/metal soap weight ratio was low, the inner region of the copying machine was severely contaminated, and the carrier attachment was generated. On the other hand, black points were generated in Comparative Example 2, in which the silica/metal soap weight ratio was high.

The addition amount of the silica particles was changed in each of Examples 6 and 7. In Example 6, in which the silica addition amount was small, the carrier attachment was slightly observed, the inner region of the copying machine was slightly contaminated, and the storage properties were somewhat poor. On the other hand, in Example 7 in which the silica addition amount was large, the fine line reproducibility under a high humidity was found to be somewhat poor.

Further, in Comparative Example 3 in which the surface roughness Rz of the photoreceptor was changed, black points were generated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus, comprising:

an image carrier having a surface roughness Rz not larger than 1.0;

a developing device arranged to face said image carrier, housing a developing agent comprising a toner consisting of toner particles and additives mixed with said toner particles, said toner particles containing a binder resin, a coloring agent, and 5 to 7% by weight of a wax, and said additives consisting of 0.08 to 0.6% by weight of silica particles and 0.008 to 0.01% by weight of zinc stearate, the weight ratio of said silica particles to said zinc stearate falling within a range of between 10 and 60, and serving to develop an electrostatic latent image formed on said image carrier so as to form a developing agent image;

a transfer device for transferring said developing agent image onto a transfer material; and a fixing device having a heating member and serving to fix the developing agent image transferred onto said transfer material.

2. The image forming apparatus according to claim 1, wherein the developing agent further comprises a carrier.

3. The image forming apparatus according to claim 2, wherein a silicone-coated carrier is used as said carrier.

4. The image forming apparatus according to claim 1, wherein said fixing device is not equipped with an oil supply mechanism.

* * * * *